US011511782B2

(12) United States Patent
Dreasher et al.

(10) Patent No.: US 11,511,782 B2
(45) Date of Patent: Nov. 29, 2022

(54) CONTROL SYSTEM FOR ENFORCING CONDITIONAL AUTHORITIES USING VEHICLE-TO-VEHICLE MONITORING

(71) Applicant: Westinghouse Air Brake Technologies Corporation, Wilmerding, PA (US)

(72) Inventors: Rebecca W. Dreasher, Longmont, CO (US); Ann K. Grimm, Cedar Rapids, IA (US); Jeffrey D. Kernwein, Cedar Rapids, IA (US); Francois Pretorius, Paonia, CO (US)

(73) Assignee: WESTINGHOUSE AIR BRAKE TECHNOLOGIES CORPORATION, Wilmerding, PA (US)

( * ) Notice: Subject to any disclaimer, the term of this patent is extended or adjusted under 35 U.S.C. 154(b) by 422 days.

(21) Appl. No.: 16/809,248

(22) Filed: Mar. 4, 2020

(65) Prior Publication Data

US 2020/0198677 A1 Jun. 25, 2020

Related U.S. Application Data

(63) Continuation-in-part of application No. PCT/US2018/049480, filed on Sep. 5, 2018.

(Continued)

(51) Int. Cl.

*B61L 27/04* (2006.01)
*B61L 25/02* (2006.01)

(Continued)

(52) U.S. Cl.

CPC ..... *B61L 27/04* (2013.01); *B61L 25/025* (2013.01); *B61L 27/10* (2022.01); *B61L 27/40* (2022.01); *B61L 2201/00* (2013.01)

(58) Field of Classification Search

CPC ..... B61L 27/04; B61L 27/10; B61L 27/40; B61L 27/20; B61L 25/025; B61L 2201/00; B61L 21/10; B61L 15/0072

See application file for complete search history.

(56) References Cited

U.S. PATENT DOCUMENTS

2001/0044695 A1 11/2001 Doner
2008/0231506 A1 9/2008 Stull et al.

(Continued)

FOREIGN PATENT DOCUMENTS

CA 2882207 A1 * 3/2014 ..... B61L 15/0063
EP 2455270 A2 * 5/2012

OTHER PUBLICATIONS

Cothen; Integration of Railway Electronic Systems to Achieve Safety and Efficiency; Proc. of the 2012 Joinr Rail Conf.; Apr. 17-19, 2012; Philadelphia, PA; pp. 1-10 (Year: 2012).*

(Continued)

*Primary Examiner* — Michael J Zanelli
(74) *Attorney, Agent, or Firm* — Christopher R. Carroll; The Small Patent Law Group LLC

(57) ABSTRACT

A control system includes a first vehicle controller configured to be disposed onboard a first vehicle system moving along route segments and to receive a conditional movement authority that has a condition to be met before the first vehicle system can travel into a designated route segment of the route segments. The first vehicle controller is configured to communicate with a separate, second vehicle system to determine a state of the second vehicle system. The first vehicle controller is configured to determine whether the state of the second vehicle system satisfies the condition of the conditional movement authority. The first vehicle controller also is configured to permit movement of the first vehicle system into the designated route segment responsive (Continued)

to determining that the state of the second vehicle system satisfies the condition of the conditional movement authority.

19 Claims, 3 Drawing Sheets

Related U.S. Application Data

(60) Provisional application No. 62/554,667, filed on Sep. 6, 2017.

(51) Int. Cl.
*B61L 27/10* (2022.01)
*B61L 27/40* (2022.01)

(56) References Cited

U.S. PATENT DOCUMENTS

| | | | |
|---|---|---|---|
| 2009/0105893 | A1 | 4/2009 | Kernwein |
| 2009/0184212 | A1 | 7/2009 | Allshouse et al. |
| 2011/0172856 | A1 | 7/2011 | Kull |
| 2013/0261856 | A1 | 10/2013 | Sharma et al. |
| 2013/0334373 | A1 | 12/2013 | Malone, Jr. et al. |
| 2014/0088865 | A1 | 3/2014 | Thies et al. |
| 2015/0353110 | A1 | 12/2015 | Kernwein et al. |
| 2016/0046307 | A1 | 2/2016 | Miyajima |
| 2017/0113707 | A1 | 4/2017 | Ghaly |
| 2019/0377364 | A1* | 12/2019 | Harvey ..... G05D 1/0022 |
| 2022/0119020 | A1* | 4/2022 | Thiyagarajan ..... B61L 3/008 |
| 2022/0185346 | A1* | 6/2022 | Oswald ..... B61L 25/025 |

OTHER PUBLICATIONS

Lindsey; Position Train Control in North America; IEEE Vehicular Technology Magazine; Dec. 2009; pp. 22-26 (Year: 2009).*

Lindqvist et al.; Application of communication based Moving Block systems on existing metro lines; Computers in Railways; WIT Transactions on the Built Environment, vol. 88; © 2006 WIT Press (Year: 2006).*

International Search Report and Written Opinion for PCT/US2018/049480 dated Nov. 15, 2018 (8 pages).

* cited by examiner

CONTROL SYSTEM FOR ENFORCING CONDITIONAL AUTHORITIES USING VEHICLE-TO-VEHICLE MONITORING

CROSS-REFERENCE TO RELATED APPLICATIONS

This application is a continuation-in-part of International Patent Application No. PCT/US2018/049480, filed on 5 Sep. 2018, which claims priority to U.S. Provisional Application No. 62/554,667, filed on 6 Sep. 2017. The entire disclosures of these applications are incorporated herein by reference.

BACKGROUND

Technical Field

The subject matter described herein relates to vehicle control systems that restrict movements of vehicles based on movement authorities.

Discussion of Art

Some known vehicle control systems support movement authorities with conditions through verbal procedures between crew and dispatcher. For example, positive train control (PTC) systems may determine where rail vehicle systems are permitted to travel subject to certain conditions based on verbal communications between onboard crews and a dispatcher. The crew may be responsible for monitoring and complying with the conditions. While the positive control vehicle systems may tolerate issuance of movement authorities with conditions, these systems may not enforce the fulfillment of the conditions. To overcome this limitation, dispatching systems may implement authority stacking, where movement authorities with conditions are queued. A dispatching system can monitor the movement of vehicle systems and issue queued movement authorities only after conditions are fulfilled.

In one example of a dynamic block operation of a positive vehicle control system, an office computer can exclusively allocate one or more route blocks or segments to each vehicle system. As the vehicle system progresses, vacated blocks are released and potentially allocated to other vehicle systems. The spacing of the vehicle systems by the positive vehicle control system may be a function of the size of the blocks and the speed of the release and allocation process. Efficient use of the dynamic block operation can require that a network of routes be subdivided into smaller block sections and provide robust communications between onboard computers that implement the movement authorities and an off-board back-office computer that generates the movement authorities.

Some vehicle control networks are not able to employ radio blocking on subdivisions where a positive vehicle control system is required because the current implementation of positive vehicle control systems, such as I-ETMS® of Wabtec Corp., do not support enforcement of the authority limits that are released from a leading vehicle system to a following vehicle system without dispatching system supervision.

Additionally, the Federal Railroad Administration (FRA) is not satisfied with the current implementation of PTC systems with regard to conditional movement authority (e.g., a movement authority that includes an "in effect after arrival" or "do not foul limits ahead/in effect behind" condition). The on-board segment or computer prompts the crew of the vehicle system holding the conditional authority to press a key to indicate the arrival of the vehicle system(s) identified in the authority. The opportunity for human error is higher than desired.

BRIEF DESCRIPTION

In one embodiment, a control system includes a first vehicle controller configured to be disposed onboard a first vehicle system moving along route segments and to receive a conditional movement authority that has a condition to be met before the first vehicle system can travel into a designated route segment of the route segments. The first vehicle controller is configured to communicate with a separate, second vehicle system to determine a state of the second vehicle system. The first vehicle controller is configured to determine whether the state of the second vehicle system satisfies the condition of the conditional movement authority. The first vehicle controller also is configured to permit movement of the first vehicle system into the designated route segment responsive to determining that the state of the second vehicle system satisfies the condition of the conditional movement authority.

In one embodiment, a method (e.g., for controlling conditional movement authorities) includes receiving a conditional movement authority at a first vehicle controller onboard a first vehicle system moving along route segments. The conditional movement authority has a condition to be met before the first vehicle system can travel into a designated route segment of the route segments. The method also can include communicating, using the first vehicle controller, with a separate, second vehicle system to determine a state of the second vehicle system, determining whether the state of the second vehicle system satisfies the condition of the conditional movement authority, and moving the first vehicle system into the designated route segment responsive to determining that the state of the second vehicle system satisfies the condition of the conditional movement authority.

In one embodiment, a vehicle controller includes one or more processors configured to be disposed onboard a first vehicle system and to receive movement authorities from an off-board controller that dictate whether the first vehicle system can enter into associated route segments. The one or more processors are configured to receive a conditional movement authority of the movement authorities that has a condition to be met before the first vehicle system can travel into a designated route segment of the route segments. The one or more processors also are configured to communicate with one or more other vehicle systems to determine whether the condition of the conditional movement authority has been met. The one or more processors are configured to permit movement of the first vehicle system into the designated route segment only after determining that the condition of the conditional movement authority is met.

BRIEF DESCRIPTION OF THE DRAWINGS

The inventive subject matter may be understood from reading the following description of non-limiting embodiments, with reference to the attached drawing, wherein below.

DETAILED DESCRIPTION

One or more embodiments of the inventive subject matter described herein include a system and method for controlling movement authorities in a positive vehicle control system. A positive vehicle control system includes a control system in which a vehicle system is allowed to move, and/or is allowed to move outside a designated restricted manner (such as above a designated penalty speed limit), only responsive to receipt or continued receipt of one or more signals (e.g., received from off-board the vehicle) that meet designated criteria, e.g., the signals have designated characteristics (e.g., a designated waveform and/or content) and/or are received at designated times (or according to other designated time criteria) and/or under designated conditions. This is opposed to 'negative' vehicle control systems where a vehicle is allowed to move unless a signal (restricting movement) is received.

Figure 1:
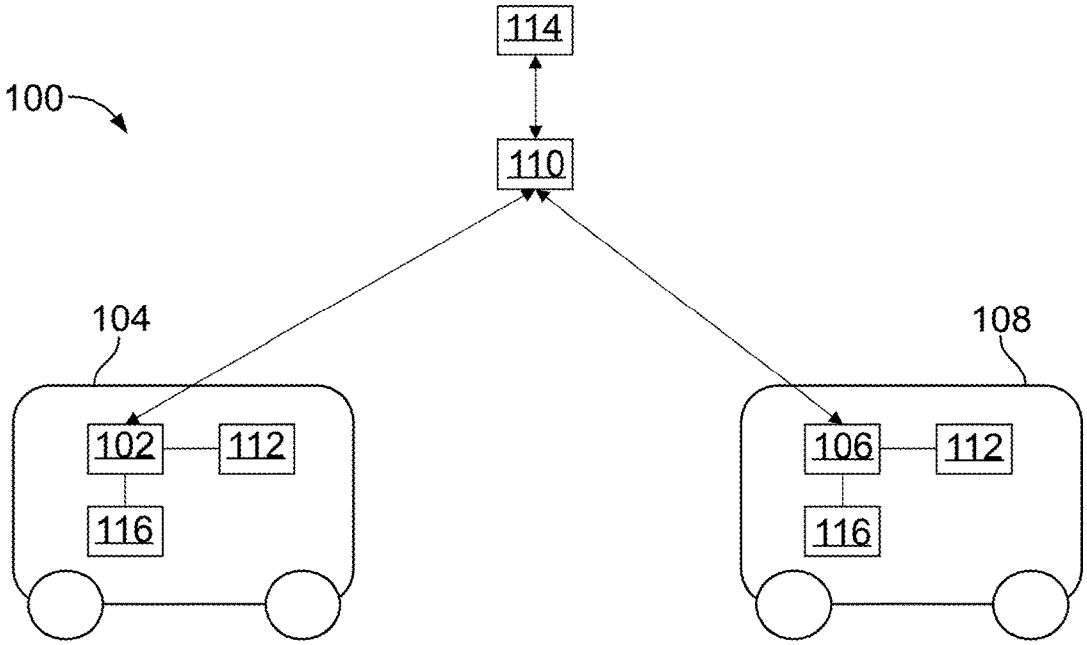
FIG. 1 illustrates one example of a control system for managing movement authorities in a positive vehicle control (PVC) system.

FIG. 1 illustrates one example of a control system 100 for managing movement authorities in a positive vehicle control (PVC) system. The control system can include a first onboard vehicle controller 102 situated on a first vehicle system 104 formed from one or more propulsion-generating vehicles. The vehicles in the first vehicle system can include locomotives, other rail vehicles, automobiles, marine vessels, mining vessels, agricultural vehicles, or the like. While one or more examples described herein focus on rail vehicles and rail vehicle systems, not all embodiments are restricted to rail vehicle systems. The control system also includes a second onboard vehicle controller 106 situated on a second vehicle system 108 formed from one or more propulsion-generating vehicles. The vehicle controllers can represent one or more processors (e.g., one or more microprocessors, field programmable gate arrays, integrated circuits, etc.) that perform operations described herein. The control system also can include a back office controller 110 that is remote from and off-board the first and second vehicle systems.

The vehicle controllers and the back office controller are communicatively connected to each other via one or more networks. For example, each of these controllers can include or be connected with transceiving hardware, such as one or more antennas, transceivers, modems, or the like, that are used to communicate with each other. The first and second vehicle controllers respectively receive a first or second movement authority from the back office controller. For example, the back office controller can send a first movement authority to the first vehicle controller and a second movement authority to the second vehicle controller. The second movement authority can include a condition that constrains the second movement authority by the first movement authority so that a movement of the second vehicle system is dependent on a movement of the first vehicle system.

The second vehicle controller is configured to directly communicate (e.g., transmit) an inquiry relating to the condition to the first vehicle controller. The first vehicle controller is configured to directly communicate a report to the second vehicle controller. This report is communicated in response to receipt of the inquiry and once the condition is satisfied or prior to satisfying the condition as determined by the second vehicle controller. The first vehicle controller may evaluate a condition involving more than one vehicle system. For example, the condition may be satisfied once two or more different (e.g., separate) vehicle systems move into and/or out of designated segments of one or more routes.

Figure 2:
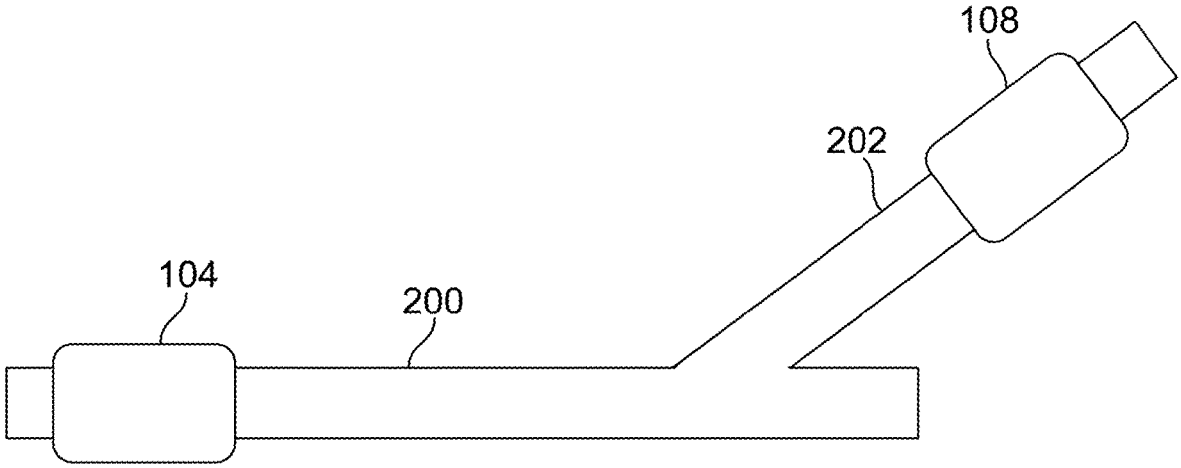
FIG. 2 illustrates vehicle systems shown in FIG. 1 onboard different route segments.

With continued reference to the control system shown in FIG. 1, FIG. 2 illustrates the vehicle systems 104, 108 onboard different route segments 200, 202. The determination that the condition is (or is not) satisfied may be made by the vehicle controller(s) based at least on the first movement authority and location data of the first vehicle system. The location data of the first vehicle system may be defined as a head-end location of the first vehicle system (e.g., the leading edge or end of the first vehicle system along a direction of travel of the first vehicle system) and a crew-confirmed point or an end-of-system location of the vehicle system (e.g., a manually identified location or a location of the trailing end of the first vehicle system along a direction of travel of the first vehicle system).

The condition that may be included in or associated with the second movement authority may include one or more of an "In Effect After Arrival" condition, a "Do Not Foul Limits Ahead/In Effect Behind" condition, or an identification of one or more vehicles of the first vehicle system and a direction of movement of the first vehicle system. The "In Effect After Arrival" condition can include a condition placed on the movement authority of a vehicle system indicating that the movement authority is not in effect beyond a designated location until one or more other (e.g., opposing) vehicle systems have arrived. The "Do Not Foul Limits Ahead/In Effect Behind" condition can be placed on the movement authority of a vehicle system indicating that the movement authority is not in effect until the route segment associated with the movement authority is no longer occupied by one or more other vehicle systems.

The second controller may be configured to direct an onboard display device 112 to display visual indicia corresponding to the movement authority and applicable condition(s). The first and second movement authorities can be received by the back office controller from a computer-aided dispatch system 114. The back office controller may determine that an overlap existing between the first and second movement authorities is valid before communicating the first and second movement authorities to the respective first and second vehicle controllers. The back office system may communicate communication parameters to the first and second vehicle controllers to effect communication between the vehicle controllers. These parameters can include network addresses or other information used to allow the vehicle controllers to communicate with each other. The second vehicle controller may be configured to directly communicate, to a plurality of other vehicle controllers, respective inquiries relating to respective conditions associated with a plurality of movement authorities received by the second vehicle controller.

A method for managing or controlling movement authorities in a PVC system may be performed by the control system. This method can include receiving, at the first vehicle controller, a first movement authority from the back office controller and receiving, at a second vehicle controller, a second movement authority from the back office controller. The second movement authority can include a condition that constrains the second movement authority by the first movement authority so that a movement of the second vehicle system is dependent on a movement of the first vehicle system. The method also can include the second vehicle controller communicating an inquiry relating to the condition or state of the first vehicle system to the first vehicle controller. For example, the second vehicle controller can determine the state (e.g., location, identification of occupied route segment, direction of movement, speed of movement, scheduled arrival and/or occupancy of a route segment, etc.) of the first vehicle controller by sending an inquiry signal to the first vehicle controller and receiving a responsive signal from the first vehicle controller that identifies the state of the first vehicle system. The first vehicle controller can communicate a report to the second vehicle controller in response to receipt of the inquiry either when the condition is satisfied or prior to when the condition is satisfied as determined by the second vehicle controller.

One or more embodiments of the inventive subject matter described herein may be useful to facilitate increased throughput of vehicle systems in the absence of absolute signals (e.g., timed signals or signals that are not based on the location(s) of other vehicle systems). Communication between dependent and constraining vehicle systems may be leveraged to inform a crew of a dependent vehicle system of progress of constraining vehicle systems against the conditions and to inform a crew of a constraining vehicle system of the existence of dependent vehicle systems. A constraining vehicle system may be a vehicle system whose location and/or movement is a condition precedent to a movement authority applying or being granted to another vehicle system. A dependent vehicle system may be a vehicle system who is unable to enter into a route segment until the constraining vehicle has satisfied the condition precedent. For example, a constraining vehicle system may be a first vehicle system that meets or leads another vehicle system. The movement authority held by or associated with the constraining vehicle system is not conditioned on movement of the vehicle system controlled by the dependent vehicle system. A dependent vehicle system may follow or wait for a meet with another vehicle system (e.g., the constraining vehicle system). The movement authority of the dependent vehicle system may be conditional on movement of the constraining vehicle system. The control system and method are configured to operate to have little to minimal impact to a route data file. Spacing between vehicle systems may be reduced or minimized relative to known control systems and methods without increasing the number of defined route blocks. The control system and method may operate to reduce departure delays relative to other known control systems and methods. For example, because conditional authorities may be delivered in advance of the conditions being fulfilled, the crew of a vehicle system can review a movement authority while waiting for the conditions to be met without causing departure delays. The control system and method may reduce dependence on communication between the back office controller and vehicle controllers and may implement clearance reports only when a dependent vehicle system has requested reports. This approach can distribute the burden of release and allocation of route to the vehicle controllers. The control system and method may be incrementally implemented in a PVC system without disrupting existing interoperable methods.

As used herein, the terms "communication" and "communicate" refer to the receipt or transfer of one or more signals, messages, commands, or other type of data. For one unit or component to be in communication with another unit or component means that the one unit or component is able to directly or indirectly receive data from and/or send data to the other unit or component. This can refer to a direct or indirect connection that may be wired and/or wireless in nature. Additionally, two units or components may be in communication with each other even though the data that is communicated may be modified, processed, routed, and the like, between the first and second unit or component. For example, a first unit may be in communication with a second unit even though the first unit passively receives data, and does not actively communicate data to the second unit. As another example, a first unit may be in communication with a second unit if an intermediary unit processes data from one unit and communicates processed data to the second unit. It will be appreciated that numerous other arrangements are possible.

The movement authorities with conditions are electronically issued by the back office controller to the vehicle controllers. The conditions are monitored and resolved by communication among or between the vehicle controllers without relying upon incremental authority being provided by the back office controller. A conditional authority is a movement authority that is subject to one or more conditions that may need to be satisfied for the authority to be considered in effect. The condition may be fulfilled once (in effect after arrival) or must be perpetually met (do not foul limits ahead/in effect behind). A constraining vehicle system can be the controlling vehicle system leading another vehicle system or meeting another vehicle system. A dependent vehicle system is a vehicle system following another vehicle system or waiting for a meet with another vehicle system. The movement authority of the dependent vehicle system can be conditional upon movement of the constraining vehicle system.

The back office controller can accept movement authorities from the dispatching controller, validate that any overlap among issued movement authorities is explained by an acceptable rule or authority condition, attach a code to each movement authority that represents all bulletins and restrictions that must be present on the vehicle controller to which the authority is issued, electronically communicate movement authorities to the appropriate vehicle controllers, and/or provide communication parameters to facilitate direct communication between the vehicle controllers.

The vehicle controller that is installed on a dependent vehicle system may process a movement authority message that includes one or more conditions, obtain communication parameters from the back office controller to allow direct communication with a vehicle controller associated with a condition of a movement authority, communicate with the vehicle controller(s) associated with each condition of a movement authority, monitor and update movement authority targets based on vehicle system clearance locations reported by the vehicle controller associated with each movement authority condition, and/or limit vehicle system movement to where movement authority conditions are met.

The vehicle controller installed on a constraining vehicle system may accept requests from a plurality of vehicle controllers for vehicle system clearance reports, select vehicle system clearance route locations based on a current movement authority, vehicle system head end location, and either crew-confirmed clearance points or a location of an end of the vehicle system (e.g., calculated using a global positioning system (GPS)-equipped end-of-train (EOT) device or other device), and/or report a route clearance location to all or one or more other vehicle controllers that have requested reports.

A route database 116 onboard one or more of the vehicle systems may identify dispatchable points that may be referenced by the vehicle controllers on dependent and/or constraining vehicle systems. The vehicle controllers may continue to use voice radio conversations between crews onboard different vehicle systems.

In one embodiment, a movement authority can be issued to a constraining vehicle system by the dispatching controller (e.g., a computer-aided dispatch system) specifying limits of the movement authority for the constraining vehicle system and sending that movement authority to the back office controller (e.g., a back office server or segment). The back office controller delivers the movement authority to the constraining vehicle system. A movement authority that constrains the movement authority of a dependent vehicle system may be required to be wholly unidirectional (e.g., the movement authority only permits movement of a vehicle system within a route segment along one direction, but not along another direction). The dispatching controller may determine that a bidirectional movement authority is issued separately from a movement authority that constrains the movement authority of a dependent vehicle system. The movement authority issued to a constraining vehicle system may not necessarily identify any dependent vehicle system (s).

A movement authority may be issued to a dependent vehicle system by the dispatch controller sending a movement authority to the back office controller for a dependent vehicle system. The movement authority contains the applicable condition (e.g., "in effect after arrival" or "do not foul limits ahead/in effect behind" or another condition), and identifies the constraining vehicle system(s) and the direction(s) of movement of the constraining vehicle system(s).

The back office controller can detect an overlap of limits between the movement authorities of the constraining vehicle system and dependent vehicle system, but can allow the overlap due to the presence of the condition. For example, the condition can prevent both vehicle systems from entering the same route segment and therefore the movement authorities issued to the two vehicle systems may not overlap due to the condition (because the condition may require that one vehicle system leave the route segment before the other vehicle system can enter the same route segment). Following successful transformation checking, the back office controller delivers the movement authority to the dependent vehicle system.

Figure 3:
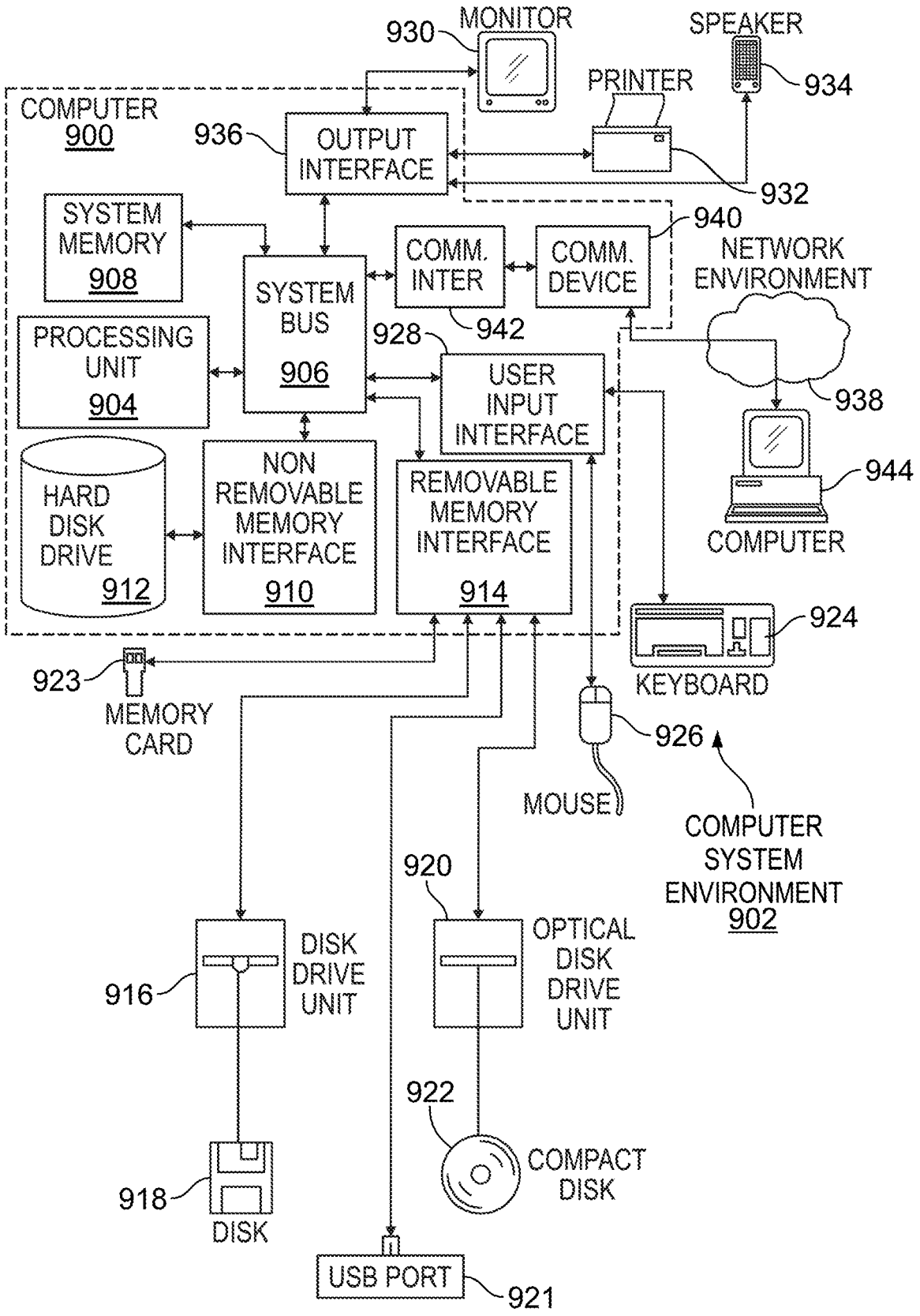
FIG. 3 is a block diagram of a computer system.

The control system may be implemented on a variety of computing devices, servers, processing units, and systems, wherein these computing devices, servers, processing units, and systems include the appropriate processing mechanisms and computer-readable media for storing and executing computer-readable instructions, such as programming instructions, code, and the like. As shown in FIG. 3, computers 900, 944, in a computing system environment 902 are provided. This computing system environment 902 may include, but is not limited to, at least one computer 900 having certain components for appropriate operation, execution of code, and creation and communication of data. For example, the computer 900 includes a processing unit 904 (typically referred to as a central processing unit or CPU) that serves to execute computer-based instructions received in the appropriate data form and format. Further, this processing unit 904 may be in the form of multiple processors executing code in series, in parallel, or in any other manner for appropriate implementation of the computer-based instructions.

In order to facilitate appropriate data communication and processing information between the various components of the computer 900, a system bus 906 is utilized. The system bus 906 may be any of several types of bus structures, including a memory bus or memory controller, a peripheral bus, or a local bus using any of a variety of bus architectures. In particular, the system bus 906 facilitates data and information communication between the various components (whether internal or external to the computer 900) through a variety of interfaces, as discussed hereinafter.

The computer 900 may include a variety of discrete computer-readable media components. For example, this computer-readable media may include any media that can be accessed by the computer 900, such as volatile media, non-volatile media, removable media, non-removable media, etc. As a further example, this computer-readable media may include computer storage media, such as media implemented in any method or technology for storage of information, such as computer-readable instructions, data structures, program modules, or other data, random access memory (RAM), read only memory (ROM), electrically erasable programmable read only memory (EEPROM), flash memory, or other memory technology, CD-ROM, digital versatile disks (DVDs), or other optical disk storage, magnetic cassettes, magnetic tape, magnetic disk storage, or other magnetic storage devices, or any other medium which can be used to store the desired information and which can be accessed by the computer 900. Further, this computer-readable media may include communications media, such as computer-readable instructions, data structures, program modules, or other data in other transport mechanisms and include any information delivery media, wired media (such as a wired network and a direct-wired connection), and wireless media. Computer-readable media may include all machine-readable media with the possible exception of transitory, propagating signals. Of course, combinations of any of the above should also be included within the scope of computer-readable media.

The computer 900 further includes a system memory 908 with computer storage media in the form of volatile and non-volatile memory, such as ROM and RAM. A basic input/output system (BIOS) with appropriate computer-based routines assists in transferring information between components within the computer 900 and is normally stored in ROM. The RAM portion of the system memory 908 typically contains data and program modules that are immediately accessible to or presently being operated on by processing unit 904, e.g., an operating system, application programming interfaces, application programs, program modules, program data and other instruction-based computer-readable codes.

With continued reference to FIG. 3, the computer 900 may also include other removable or non-removable, volatile or non-volatile computer storage media products. For example, the computer 900 may include a non-removable memory interface 910 that communicates with and controls a hard disk drive 912, i.e., a non-removable, non-volatile magnetic medium; and a removable, non-volatile memory interface 914 that communicates with and controls a magnetic disk drive unit 916 (which reads from and writes to a removable, non-volatile magnetic disk 918), an optical disk drive unit 920 (which reads from and writes to a removable, non-volatile optical disk 922, such as a CD-ROM), a Universal Serial Bus (USB) port 921 for use in connection with a removable memory card, etc. However, it is envisioned that other removable or non-removable, volatile or non-volatile computer storage media can be used in the exemplary computing system environment 900, including, but not limited to, magnetic tape cassettes, DVDs, digital video tape, solid state RAM, solid state ROM, etc. These various removable or non-removable, volatile or nonvolatile magnetic media are in communication with the processing unit 904 and other components of the computer 900 via the system bus 906. The drives and their associated computer storage media discussed above and illustrated in FIG. 1 provide storage of operating systems, computer-readable instructions, application programs, data structures, program modules, program data and other instruction-based computer-readable code for the computer 900 (whether duplicative or not of this information and data in the system memory 908).

A user may enter commands, information, and data into the computer 900 through certain attachable or operable input devices, such as a keyboard 924, a mouse 926, etc., via a user input interface 928. Of course, a variety of such input devices may be utilized, e.g., a microphone, a trackball, a joystick, a touchpad, a touch-screen, a scanner, etc., including any arrangement that facilitates the input of data, and information to the computer 900 from an outside source. As discussed, these and other input devices are often connected to the processing unit 904 through the user input interface 928 coupled to the system bus 906, but may be connected by other interface and bus structures, such as a parallel port, game port, or a universal serial bus (USB). Still further, data and information can be presented or provided to a user in an intelligible form or format through certain output devices, such as a monitor 930 (to visually display this information and data in electronic form), a printer 932 (to physically display this information and data in print form), a speaker 934 (to audibly present this information and data in audible form), etc. All of these devices are in communication with the computer 900 through an output interface 936 coupled to the system bus 906. It is envisioned that any such peripheral output devices be used to provide information and data to the user.

The computer 900 may operate in a network environment 938 through the use of a communications device 940, which is integral to the computer or remote therefrom. This communications device 940 is operable by and in communication to the other components of the computer 900 through a communications interface 942. Using such an arrangement, the computer 900 may connect with or otherwise communicate with one or more remote computers, such as a remote computer 944, which may be a personal computer, a server, a router, a network personal computer, a peer device, or other common network nodes, and typically includes many or all of the components described above in connection with the computer 900. Using appropriate communication devices 940, e.g., a modem, a network interface or adapter, etc., the computer 900 may operate within and communication through a local area network (LAN) and a wide area network (WAN), but may also include other networks such as a virtual private network (VPN), an office network, an enterprise network, an intranet, the Internet, etc. It will be appreciated that the network connections shown are exemplary and other means of establishing a communications link between the computers 900, 944 may be used.

As used herein, the computer 900 includes or is operable to execute appropriate custom-designed or conventional software to perform and implement the processing steps of the method and system of the inventive subject matter, thereby, forming a specialized and particular computing system. Accordingly, the presently-invented method and system may include one or more computers 900 or similar computing devices having a computer-readable storage medium capable of storing computer-readable program code or instructions that cause the processing unit 904 to execute, configure or otherwise implement the methods, processes, and transformational data manipulations discussed hereinafter in connection with the inventive subject matter. Still further, the computer 900 may be in the form of a personal computer, a personal digital assistant, a portable computer, a laptop, a palmtop, a mobile device, a mobile telephone, a server, or any other type of computing device having the necessary processing hardware to appropriately process data to effectively implement the presently-invented computer-implemented method and system.

The system may utilize databases physically located on one or more computers which may or may not be the same as their respective servers. For example, programming software on computer 900 can control a database physically stored on a separate processor of the network or otherwise.

Figure 4:
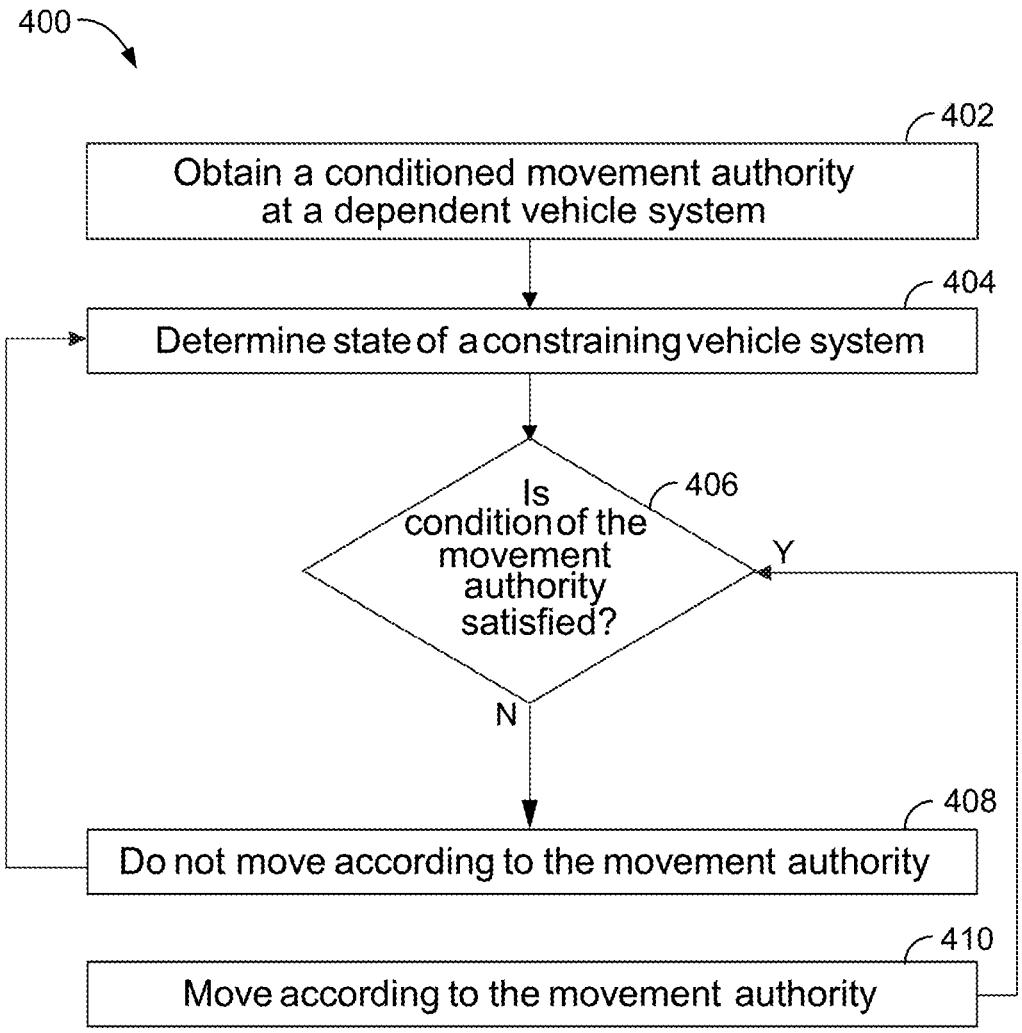
FIG. 4 illustrates a flowchart of one embodiment of a method for managing or otherwise controlling conditional authorities of vehicle systems.

FIG. 4 illustrates a flowchart of one embodiment of a method 400 for managing or controlling conditional authorities of vehicle systems. The method can represent at least some of the operations performed by at least one of the vehicle controllers (e.g., the second vehicle controller or the vehicle controller of the dependent vehicle system). Optionally, one or more of the operations may be performed by another controller, such as the back office controller. At 402, a movement authority is received at a dependent vehicle system. This movement authority may be a conditioned movement authority in that the dependent vehicle system is not able to move according to the movement authority until a condition involving a state of another vehicle system (e.g., a constraining vehicle system) is satisfied. At 404, the state of the constraining vehicle system is determined. For example, the vehicle controller onboard the dependent vehicle system may automatically send an inquiry signal to the constraining vehicle system that asks for a state of the constraining vehicle system. The vehicle controller of the constraining vehicle system can send a responsive signal that includes the state of the constraining vehicle system to determine the state of the constraining vehicle system.

Using this determined state, at 406, a determination is made as to whether the condition of the movement authority is satisfied. For example, the dependent vehicle controller can directly communicate with the constraining vehicle controller to determine whether the state of the constraining vehicle controller satisfies the condition. If the state of the constraining vehicle satisfies the condition, then the dependent vehicle system may be able to currently move according to the movement authority. As a result, flow of the method can proceed toward 410. But, if the state of the constraining vehicle does not satisfy the condition, then the dependent vehicle system may not be able to move according to the movement authority. As a result, flow of the method can proceed toward 408.

At 408, the dependent vehicle system does not move into the route segment associated with the conditional movement authority. Because the state of the constraining vehicle system does not meet or satisfy the condition of the movement authority, it may be unsafe for the dependent vehicle system to move into the route segment of the movement authority. The vehicle controller of the dependent vehicle system may automatically slow or stop movement of the dependent vehicle system (by communicating control signals with engines, motors, brakes, or the like of the vehicle system) to prevent the dependent vehicle system from moving into the route segment of the conditional movement authority. Flow of the method can return toward 404 so the vehicle controller of the dependent vehicle system can continue monitoring or otherwise determining the state of the constraining vehicle system. Alternatively, flow of the method can terminate.

At 410, the dependent vehicle system moves according to the movement authority. For example, responsive to the vehicle controller of the dependent vehicle system determining that the state of the constraining vehicle system satisfies the condition of the movement authority of the dependent vehicle system (by obtaining the state of the constraining vehicle system from the constraining vehicle system), the vehicle controller of the dependent vehicle system can automatically move or allow manual movement of the dependent vehicle system according to the movement authority. For example, the vehicle controller may no longer prevent the dependent vehicle system from moving into the route segment associated with the conditional movement authority. Flow of the method can then terminate or return to a prior operation (e.g., 402).

Although the inventive subject matter has been described in detail for the purpose of illustration based on what is currently considered to be the most practical and preferred embodiments, it is to be understood that such detail is solely for that purpose and that the inventive subject matter is not limited to the disclosed embodiments, but, on the contrary, is intended to cover modifications and equivalent arrangements that are within the spirit and scope of the appended claims, of any. For example, it is to be understood that the inventive subject matter contemplates that, to the extent possible, one or more features of any embodiment can be combined with one or more features of any other embodiment.

In one embodiment, a control system includes a first vehicle controller configured to be disposed onboard a first vehicle system moving along route segments and to receive a conditional movement authority that has a condition to be met before the first vehicle system can travel into a designated route segment of the route segments. The first vehicle controller is configured to communicate with a separate, second vehicle system to determine a state of the second vehicle system. The first vehicle controller is configured to determine whether the state of the second vehicle system satisfies the condition of the conditional movement authority. The first vehicle controller also is configured to permit movement of the first vehicle system into the designated route segment responsive to determining that the state of the second vehicle system satisfies the condition of the conditional movement authority.

Optionally, the first vehicle controller is configured to prevent entry of the first vehicle system into the designated route segment until the condition of the conditional movement authority is satisfied.

Optionally, the first vehicle controller is configured to permit movement of the first vehicle system through the route segments according to movement authorities that include the conditional movement authority issued by a back office controller of a positive vehicle control system.

Optionally, each of the movement authorities dictates whether the first vehicle system can enter into one or more of the route segments associated with the corresponding movement authority.

Optionally, the first vehicle controller is configured to communicate the second vehicle system to determine the state of the second vehicle system without the state being determined using vocal communication from the second vehicle system.

Optionally, the condition of the conditional movement authority prevents the first vehicle system from moving beyond a designated location until the second vehicle system arrives in the designated route segment.

Optionally, the condition of the conditional movement authority prevents the first vehicle system from entering the designated route segment until the second vehicle system leaves the designated route segment.

In one embodiment, a method (e.g., for controlling conditional movement authorities) includes receiving a conditional movement authority at a first vehicle controller onboard a first vehicle system moving along route segments. The conditional movement authority has a condition to be met before the first vehicle system can travel into a designated route segment of the route segments. The method also can include communicating, using the first vehicle controller, with a separate, second vehicle system to determine a state of the second vehicle system, determining whether the state of the second vehicle system satisfies the condition of the conditional movement authority, and moving the first vehicle system into the designated route segment responsive to determining that the state of the second vehicle system satisfies the condition of the conditional movement authority.

Optionally, the method also can include preventing entry of the first vehicle system into the designated route segment until the condition of the conditional movement authority is satisfied.

Optionally, the conditional movement authority is received from a back office controller of a positive vehicle control system.

Optionally, each of the movement authorities dictates whether the first vehicle system can enter into one or more of the route segments associated with the corresponding movement authority.

Optionally, the state of the second vehicle system is determined with the first vehicle controller without the state being verbally communicated between the first vehicle system and the second vehicle system.

Optionally, the condition of the conditional movement authority prevents the first vehicle system from moving beyond a designated location until the second vehicle system arrives in the designated route segment.

Optionally, the condition of the conditional movement authority prevents the first vehicle system from entering the designated route segment until the second vehicle system leaves the designated route segment.

In one embodiment, a vehicle controller includes one or more processors configured to be disposed onboard a first vehicle system and to receive movement authorities from an off-board controller that dictate whether the first vehicle system can enter into associated route segments. The one or more processors are configured to receive a conditional movement authority of the movement authorities that has a condition to be met before the first vehicle system can travel into a designated route segment of the route segments. The one or more processors also are configured to communicate with one or more other vehicle systems to determine whether the condition of the conditional movement authority has been met. The one or more processors are configured to permit movement of the first vehicle system into the designated route segment only after determining that the condition of the conditional movement authority is met.

Optionally, the one or more processors are configured to receive the conditional movement authority from a back office controller of a positive vehicle control system.

Optionally, the one or more processors are configured to determine whether the condition of the conditional movement authority is satisfied based on a state of the one or more other vehicle systems.

Optionally, the one or more processors are configured to communicate with the one or more other vehicle systems to determine the state of the one or more other vehicle systems.

Optionally, the condition of the conditional movement authority prevents the first vehicle system from moving beyond a designated location until the one or more other vehicle systems arrive in the designated route segment.

Optionally, the condition of the conditional movement authority prevents the first vehicle system from entering the designated route segment until the one or more other vehicle systems leave the designated route segment.

As used herein, the terms "processor" and "computer," and related terms, e.g., "processing device," "computing device," and "controller" may be not limited to just those integrated circuits referred to in the art as a computer, but refer to a microcontroller, a microcomputer, a programmable logic controller (PLC), field programmable gate array, and application specific integrated circuit, and other programmable circuits. Suitable memory may include, for example, a computer-readable medium. A computer-readable medium may be, for example, a random-access memory (RAM), a computer-readable non-volatile medium, such as a flash memory. The term "non-transitory computer-readable media" represents a tangible computer-based device implemented for short-term and long-term storage of information, such as, computer-readable instructions, data structures, program modules and sub-modules, or other data in any device. Therefore, the methods described herein may be encoded as executable instructions embodied in a tangible, non-transitory, computer-readable medium, including, without limitation, a storage device and/or a memory device. Such instructions, when executed by a processor, cause the processor to perform at least a portion of the methods described herein. As such, the term includes tangible, computer-readable media, including, without limitation, non-transitory computer storage devices, including without limitation, volatile and non-volatile media, and removable and non-removable media such as firmware, physical and virtual storage, CD-ROMS, DVDs, and other digital sources, such as a network or the Internet.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. Such other examples are intended to be within the scope of the claims if they have structural elements that do not differ from the literal language of the claims, or if they include equivalent structural elements with insubstantial differences from the literal language of the claims.

What is claimed is:

1. A control system comprising:

a first vehicle controller configured to be disposed onboard a first vehicle system moving along route segments and to receive a conditional movement authority that has a condition to be met before the first vehicle system can travel into a designated route segment of the route segments, the first vehicle controller configured to communicate with a separate, second vehicle system to determine a state of the second vehicle system, the state of the second vehicle system including one or more of a moving direction of the second vehicle system, a moving speed of the second vehicle system, or a scheduled arrival time of the second vehicle system, the first vehicle controller configured to determine whether the state of the second vehicle system satisfies the condition of the conditional movement authority, the first vehicle controller configured to permit movement of the first vehicle system into the designated route segment responsive to determining that the state of the second vehicle system satisfies the condition of the conditional movement authority.

2. The control system of claim 1, wherein the first vehicle controller is configured to prevent entry of the first vehicle system into the designated route segment until the condition of the conditional movement authority is satisfied.

3. The control system of claim 1, wherein the first vehicle controller is configured to permit movement of the first vehicle system through the route segments according to movement authorities that include the conditional movement authority issued by a back office controller of a positive vehicle control system.

4. The control system of claim 3, wherein each of the movement authorities dictates whether the first vehicle system can enter into one or more of the route segments associated with the corresponding movement authority.

5. The control system of claim 1, wherein the first vehicle controller is configured to communicate with the second vehicle system to determine the state of the second vehicle system without the state being determined using vocal communication from the second vehicle system.

6. The control system of claim 1, wherein the condition of the conditional movement authority prevents the first vehicle system from moving beyond a designated location until the second vehicle system arrives in the designated route segment.

7. The control system of claim 1, wherein the condition of the conditional movement authority prevents the first vehicle system from entering the designated route segment until the second vehicle system leaves the designated route segment.

8. A method comprising:

receiving a conditional movement authority at a first vehicle controller onboard a first vehicle system moving along route segments, the conditional movement authority having a condition to be met before the first vehicle system can travel into a designated route segment of the route segments;

communicating, using the first vehicle controller, with a separate, second vehicle system to determine a state of the second vehicle system, the state of the second vehicle system including one or more of a moving direction of the second vehicle system, a moving speed of the second vehicle system, or a scheduled arrival time of the second vehicle system;

determining whether the state of the second vehicle system satisfies the condition of the conditional movement authority; and moving the first vehicle system into the designated route segment responsive to determining that the state of the second vehicle system satisfies the condition of the conditional movement authority.

9. The method of claim 8, further comprising:

preventing entry of the first vehicle system into the designated route segment until the condition of the conditional movement authority is satisfied.

10. The method of claim 8, wherein the conditional movement authority is received from a back office controller of a positive vehicle control system.

11. The method of claim 10, wherein each of the movement authorities dictates whether the first vehicle system can enter into one or more of the route segments associated with the corresponding movement authority.

12. The method of claim 8, wherein the state of the second vehicle system is determined with the first vehicle controller without the state being verbally communicated between the first vehicle system and the second vehicle system.

13. The method of claim 8, wherein the condition of the conditional movement authority prevents the first vehicle system from moving beyond a designated location until the second vehicle system arrives in the designated route segment.

14. The method of claim 8, wherein the condition of the conditional movement authority prevents the first vehicle system from entering the designated route segment until the second vehicle system leaves the designated route segment.

15. A vehicle controller comprising:

one or more processors configured to be disposed onboard a first vehicle system and to receive movement authorities from an off-board controller that dictate whether the first vehicle system can enter into associated route segments, the one or more processors configured to receive a conditional movement authority of the movement authorities that has a condition to be met by a state of a second vehicle system before the first vehicle system can travel into a designated route segment of the route segments, the state of the second vehicle system including one or more of a moving direction of the second vehicle system, a moving speed of the second vehicle system, or a scheduled arrival time of the second vehicle system, the one or more processors configured to communicate with one or more other vehicle systems to determine whether the condition of the conditional movement authority has been met, the one or more processors configured to permit movement of the first vehicle system into the designated route segment only after determining that the condition of the conditional movement authority is met.

16. The vehicle controller of claim 15, wherein the one or more processors are configured to receive the conditional movement authority from a back office controller of a positive vehicle control system.

17. The vehicle controller of claim 15, wherein the one or more processors are configured to communicate with the second vehicle system to determine the state of the second vehicle system.

18. The vehicle controller of claim 15, wherein the condition of the conditional movement authority prevents the first vehicle system from moving beyond a designated location until the second vehicle system arrives in the designated route segment.

19. The vehicle controller of claim 15, wherein the condition of the conditional movement authority prevents the first vehicle system from entering the designated route segment until the second vehicle system leaves the designated route segment.

* * * * *